US006871667B2

(12) United States Patent
Schwing et al.

(10) Patent No.: US 6,871,667 B2
(45) Date of Patent: Mar. 29, 2005

(54) DISTRIBUTION DEVICE FOR THICK MATTER, ESPECIALLY FOR CONCRETE

(75) Inventors: Friedrich Schwing, Gelsenkirchen (DE); Horst Heckmann, Sprockhövel (DE)

(73) Assignee: Schwing GmbH, Herne (DE)

( * ) Notice: Subject to any disclaimer, the term of this patent is extended or adjusted under 35 U.S.C. 154(b) by 0 days.

(21) Appl. No.: 10/467,787

(22) PCT Filed: Feb. 7, 2002

(86) PCT No.: PCT/EP02/01290

§ 371 (c)(1),
(2), (4) Date: Jan. 22, 2004

(87) PCT Pub. No.: WO02/064911

PCT Pub. Date: Aug. 22, 2002

(65) Prior Publication Data

US 2004/0108003 A1 Jun. 10, 2004

(30) Foreign Application Priority Data

Feb. 12, 2001 (DE) ..... 101 06 427

(51) Int. Cl.[7] ..... G05D 7/00
(52) U.S. Cl. ..... 137/615; 141/387
(58) Field of Search ..... 137/615; 141/387, 141/388

(56) References Cited

U.S. PATENT DOCUMENTS 3,707,990 A 1/1973 Schaible
4,130,134 A 12/1978 Castle
5,535,780 A * 7/1996 Schlecht et al. ..... 137/615
6,463,958 B1 10/2002 Schwing

FOREIGN PATENT DOCUMENTS

EP 432 854 B1 11/1990
WO WO 00/24988 10/1999

* cited by examiner

*Primary Examiner*—Kevin Lee
(74) *Attorney, Agent, or Firm*—VanOphem & VanOphem P.C.

(57) ABSTRACT

A distribution device for dense substances, especially concrete, with a distribution boom carrying a concrete-conveyance conduit, with at least one telescopic boom section (4) consisting of a first telescopic component and a second telescope component (6) that can be extended with respect to this first component, as well as at least one reinforcement beam that is arranged on one of the telescope components and carries a section of the concrete-conveyance conduit, wherein a section of the concrete-conveyance conduit in the region of the telescopic boom sections consists of a flexible hose with a compensation loop to accommodate the extension movement of the telescopic motion or of at least one scissor-type conduit assembly made up of swivel elements connected to each other in such a manner than the swivel elements in the two terminal positions of the telescopic boom section are substantially arranged in a crossover position and, together with the articulated joints that interconnect them, move past each other during the extension and retraction of the telescopic boom section, is characterized in that the reinforcement beam that carries a section of the concrete-conveyance conduit in the region of the telescopic boom section has one of its ends connected to the extensible (second) telescope component and its other end connected to the relatively immobile (first) telescope component.

18 Claims, 6 Drawing Sheets

DISTRIBUTION DEVICE FOR THICK MATTER, ESPECIALLY FOR CONCRETE

BACKGROUND OF THE INVENTION

1. Field of the Invention

The invention relates to an apparatus in the form of a concrete conveying device for conveying fluent material.

2. Description of the Related Prior Art

Such distribution devices are known (EP 432 854 and WO 00/24988). They are provided with a telescopic boom section that is pivotally jointed to a slewing track ring for the distributor and by means of a hydraulic cylinder unit can be swiveled from a horizontal transport or rest position up to a substantially vertical working position. By means of this slewing track ring the distribution boom is mounted on an appropriate transport vehicle, possibly a motor lorry or crane truck. These distribution booms serve to carry conduits, especially for the conveyance of concrete, and are used for the most part for the distribution of concrete for the production of ceiling slabs of buildings and the like. To this end the concrete-conveyance conduit is carried by the telescopic section of the distribution boom and therefore must be adjustable with respect to the boom as it is extended. For this purpose there are known scissor-type conveyance conduits made up of swiveling elements connected to each other by means of articulated joints. When the telescopic section of the boom is extended, these conduit elements are swiveled in the manner of scissors, so that the conveyance-conduit elements with their articulated joints move past each other, after which the conveyance conduit can follow the telescopic movement.

In the case of the distribution device in accordance with EP 432 854 B1 both the relatively immobile section of the telescopic and the section that moves relative thereto are provided with a reinforcement beam to which are attached, respectively, the part of the concrete-conveyance conduit that leads to the telescope and the part that leads away from it. This leads to a comparatively large, heavy and space-consuming structure. The telescopic section of the boom and the extensible part of the telescope, which carries the follow-up sections of the conveyance conduit, becomes subject to considerable forces, especially when high pumping pressures occur during operation or on the occasion of substantial pumping strokes when the pumping head changes. Accordingly, such heavy loads call for an appropriately massive construction of the telescope. In the case of the distribution boom in accordance with WO 00/24988, on the other hand, the articulated concrete-conveyance conduit is attached to the telescopic section of the boom by means of bearing blocks and this again places significant loads to be considered in the design of the side of the boom.

BRIEF SUMMARY OF THE INVENTION

The object of the invention is to provide a distribution device with a telescopic boom section that has a compact structure and a good load distribution and at the same time provides considerable stability.

According to the invention, this task is solved by the characteristics contained in claim 1, while advantageous further developments and embodiments of the invention are specified by the characterizing features of the dependent claims.

According to the invention, in the region of the telescopic section of the boom there is provided a reinforcement beam that carries the concrete-conveyance conduit and joins the two telescopic parts to each other. To accomplish this feature the reinforcement beam has one of its ends attached to the extensible part of the telescopic section and the other end attached to the fixed section that remains relatively immobile, i.e. it couples the two telescopic sections with each other, and this, both in the transport position and in the various intermediate positions that are reached by appropriate extensions of the extensible part of the telescopic section defines the working positions. In the extended position of the telescopic section assures a very good introduction of the force into both parts of the telescopic section. This arrangement is advantageous for the desired stable structure of the distribution device. At the same time it also leads to a simplification and reduction of the previous construction effort. For the purposes of a good force and moment distribution, and also for the purposes of saving space, it is particularly advantageous if the concrete-conveyance conduit in the region of the telescopic section can be arranged on both sides of the boom, that is to say, if the part of the concrete-conveyance conduit that leads to the telescopic section is arranged on one side of the boom, while the scissor-type assembly and the part of the concrete-conveyance conduit that leads away from the telescopic section and to the tip of the boom is arranged on the other side. This assures a very good force compensation. The fact that the reinforcement beam is guided in an elongated guide rail attached to the relatively fixed or immobile part of the telescope and is pinned at one end to the extensible part of the telescopic section assures an unconstrained guidance of the reinforcement beam that carries the concrete-conveyance conduit while the telescopic section performs its extension movement. For this purpose it is advantageous if the reinforcement beam is designed to resist both bending and torsion, as is the case if it is designed as a hollow section. The fact that both ends of the reinforcement beam are attached to the telescopic parts by means of swivel joints also assures a very good reception of the load and transfer of the force.

Particularly in the case where the concrete-conveyance conduit is arranged on both sides of the boom in the region of its telescopic section, it will be advantageous if the swivelling elements of the scissor-type assembly will be designed either as an S or as a C.

The articulation points of the scissor-type assembly, i.e. the joints at which the ends of the scissor-type assembly are connected to the sections of the concrete-conveyance conduit that, respectively, lead to and away from it and where the swivelling elements of the assembly are connected to each other, are advantageously designed as swivelling pipe joints capable of resisting bending, which constitutes an advantage in view of the pumping thrusts that occur during working process whenever there is change of the pumping head. This once again contributes to a stable design of the distribution device.

In an advantageous further feature (of the invention) the hydraulic cylinder for the folding section of the boom is connected by means of an articulated joint to the telescopic section and is further flexibly connected by means of a conventional articulated linkage in the region of the leading end of the extensible part of the telescope. Its other end is firmly attached to the folding section of the boom, which has the advantage that maximum use is made of the extension path, especially that it is not reduced by the full length of the hydraulic cylinder, as is the case in conventional construction techniques, because there the hydraulic cylinder is normally articulated to the previous section of the boom.

Owing to this further development of the invention, the outer part of the telescopic section can be pulled back as far as the articulate linkage when the telescopic section is retracted into its final position. We are here concerned with an advantageous further development, but also with a superordinate inventive principle in its own right that is independent of the reinforcement beam advantage between the two telescopic boom components and can be advantageously employed also in other conditions.

Lastly, it will be advantageous if the other conduits and hosepipes—for example hydraulic conduits and hoses, electric cables and the like—needed to assure energy supplies are bundled and, in the region of the telescopic section of the boom, are then led as a bundle along the course of the scissor-type assembly of the concrete-conveyance conduit and attached thereto with appropriate means. In this connection it will be particularly advantageous if the supply bundle is protectively accommodated inside the hollow section of the reinforcement beam.

A further advantage is constituted by the telescopic boom section in combination with further boom sections that are articulated to it and can be folded, because this confers better slip-in properties upon the distribution boom, i.e. it makes it easier to pass the tip of the boom through windows or other wall openings. As a consequence, the distribution boom also becomes particularly advantageous for employment on construction sites where the available working height is limited, use inside halls being a case in point.

BRIEF DESCRIPTION OF THE SEVERAL VIEWS OF THE DRAWINGS

A preferred embodiment of the invention will now be described with the help of the drawings. The drawings, all of which are purely schematic, are as follows.

DETAILED DESCRIPTION OF THE PREFERRED EMBODIMENT OF THE INVENTION

Figures 1, 2, 3:
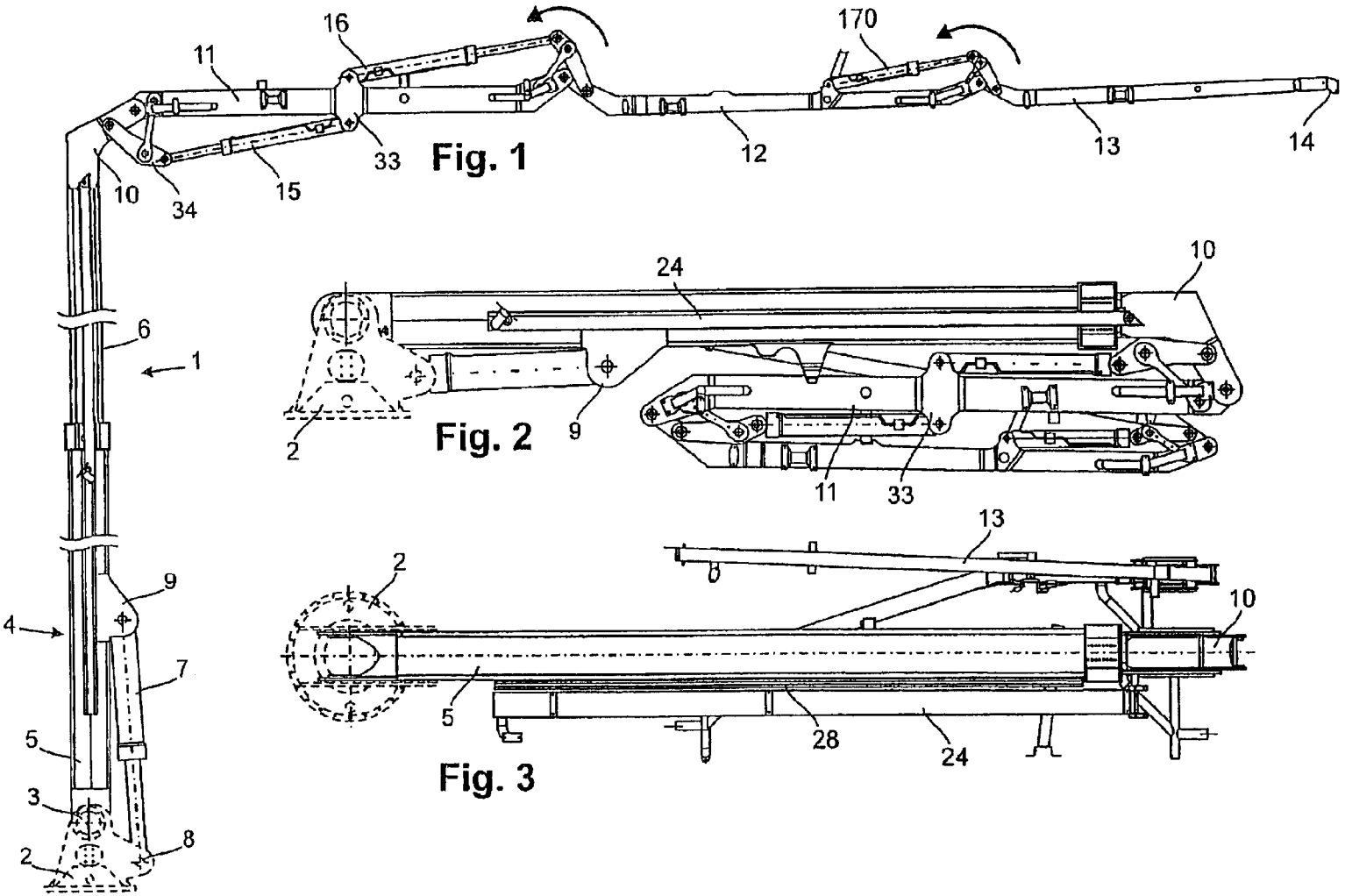
FIG. 1 shows a view of an embodiment of the distribution boom in accordance with the invention in the working position with fully extended and unfolded boom sections.
FIG. 2 shows a view of the distribution boom shown in FIG. 1 in the transport position, i.e. with the boom sections in their back-folded position.
FIG. 3 shows the distribution boom of FIG. 2 as seen from above.

Together with its slewing track ring 2, the distribution boom 1 illustrated in FIGS. 1 to 3 is usually mounted on a motorized base, possibly a motor lorry or a mobile crane truck. However, the structure may also be erected in a fixed position. The illustrated distribution boom is provided with a telescopic section 4 that is pivotally attached to the slewing track ring 2 at the telescopic section 4 and consists of a first fixed or outer telescopic component 5 and a second or inner telescopic component 6 that can move inside the first. By means of a hydraulic cylinder 7, the telescopic section 4 can be swiveled through an angle of up to 90° from a horizontal transport position illustrated in FIG. 2 into a working position as illustrated in FIG. 1. For this purpose the hydraulic cylinder 7 is pivotally attached to a bracket 8 that projects from the slewing track ring 2. The other end of the hydraulic cylinder 7 is pivotally attached to a bracket 9 arranged on the outer telescopic component 5. The upper end of the inner telescopic component 6, which points in the direction of the tip of the distribution boom, is provided with an angle bracket 10. Attached to the angle bracket 10 is a pivotable foldable section 11 of the boom. This section carries another boom section 12 and attached thereto is a third foldable boom section 13 that constitutes the boom tip 14, all joints being appropriately articulated. To these pivotable boom sections 5–13 there is attached a concrete-conveyance conduit, which is not shown in FIGS. 1 to 3 in order to simplify the illustrations. The concrete-conveyance conduit terminates with a flexible spout at the boom tip 14 and, when the distribution boom is appropriately extended and swiveled, can be moved into any desired working position to distribute the conveyed concrete.

In the illustrated embodiment of FIG. 1 there is provided hydraulic cylinders 15, 16 and 17 for the foldable boom sections 11, 12 and 13. The foldable section 11 and boom section 12 are folded by means of a so-called Z-fold, while the third foldable boom section 13 can be folded back by means of a so-called rolling fold. This folding is illustrated in FIG. 2. In greater detail, when the distribution boom is to be brought into the transport position illustrated by FIG. 2, the foldable section 11 is pivoted by means of the hydraulic cylinder 15 in the direction of the arrow shown in FIG. 1, while the boom section 12 and third foldable boom section 13 are pivoted in the direction indicated by the arrows. The illustrations of FIGS. 1 to 3 illustrate the fact that, if a compact structure is to be obtained, all the moving parts have to be carefully stacked to each other. The arrangement of the concrete-conveyance conduit that is described in greater detail by the subsequent figures is well suited for this purpose.

Figure 4:
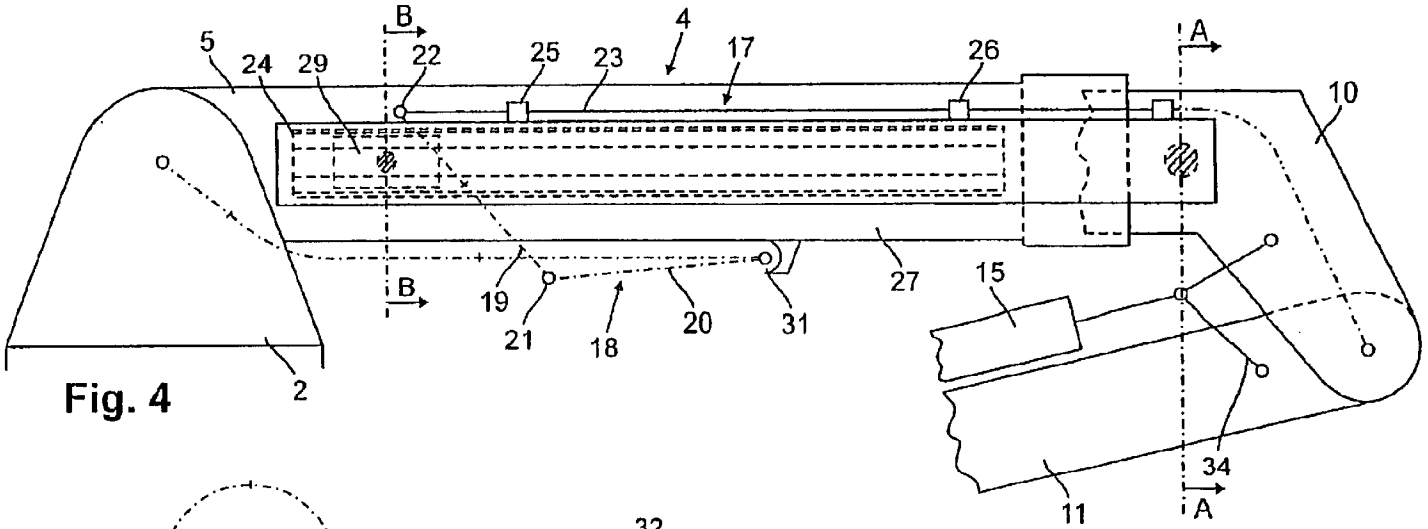
FIG. 4 shows a schematic representation of the telescopic boom section of a distribution boom as illustrated by FIGS. 1 to 3.
Figure 5:
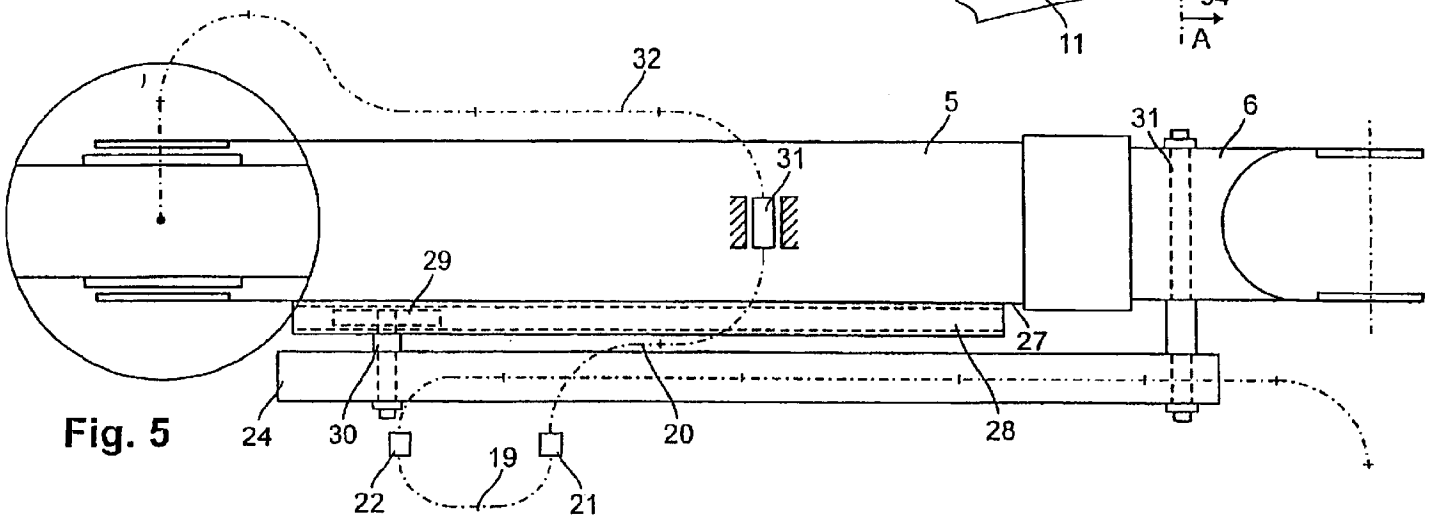
FIG. 5 shows the distribution boom in accordance with FIG. 4 as seen from above.

To this end FIGS. 4 and 5, both of which are schematic representations, show the telescopic section 4, mounted on the slewing track ring 2. The dash-dotted and partly continuous line 17*a* indicates the concrete-conveyance conduit 17. The concrete-conveyance conduit 17 is usually made up of pipes joined together in the manner of a pipeline, but may also be constituted either wholly or in part by a hosepipe. The concrete-conveyance conduit 17 is attached by means of a flange connection in the region of the slewing track ring 2, so that it can be attached to and supplied by means of a concrete pump. Generally a twin-cylinder pump is used, for dense substances such as concrete, and it is usually mounted on the motor lorry or a crane truck. In order to compensate for the telescopic movement of the telescopic section 4 due to an extension of the second telescopic component 6, a scissor-type conduit assembly is provided in the region of the telescopic section, here generically indicated by the reference number 18. The conduit assembly consists of a swivel element 19 and a second swivel element 20. The two swivel elements 19 at 20 are connected to each other by means of an articulated joint 21. Further a second articulated joint 22 connects the swivel element 19 to a section 23 of the concrete-conveyance conduit 17 that leads away from the scissor assembly. This section 23 of the concrete-conveyance conduit 17 leading away from the scissors is attached to a reinforcement beam 24 and, more precisely, to the top surface of this beam, as can be seen in FIG. 5. The points at which the conduit is attached are indicated in FIG. 4 by 25 and 26.

In this case the reinforcement beam 24 is arranged on the side of the relatively fixed telescopic component 5 and, more particularly, in such a manner as to enable it to slide along relative thereto. To enable the sliding movement an elongated guide rail 28, indicated in FIGS. 4 and 5 by means of a broken line, is arranged on the side face of the fixed telescopic component 5. As can be seen from FIGS. 5 and 7, this elongated guide rail 28 is provided with a slotted groove in which the reinforcement beam is guided by means of a slider 29. Alternatively, a roller bearing can also be used. In any case, the slider 29 is advantageously connected to the reinforcement beam by means of a fulcrum pin 30.

Figure 14:
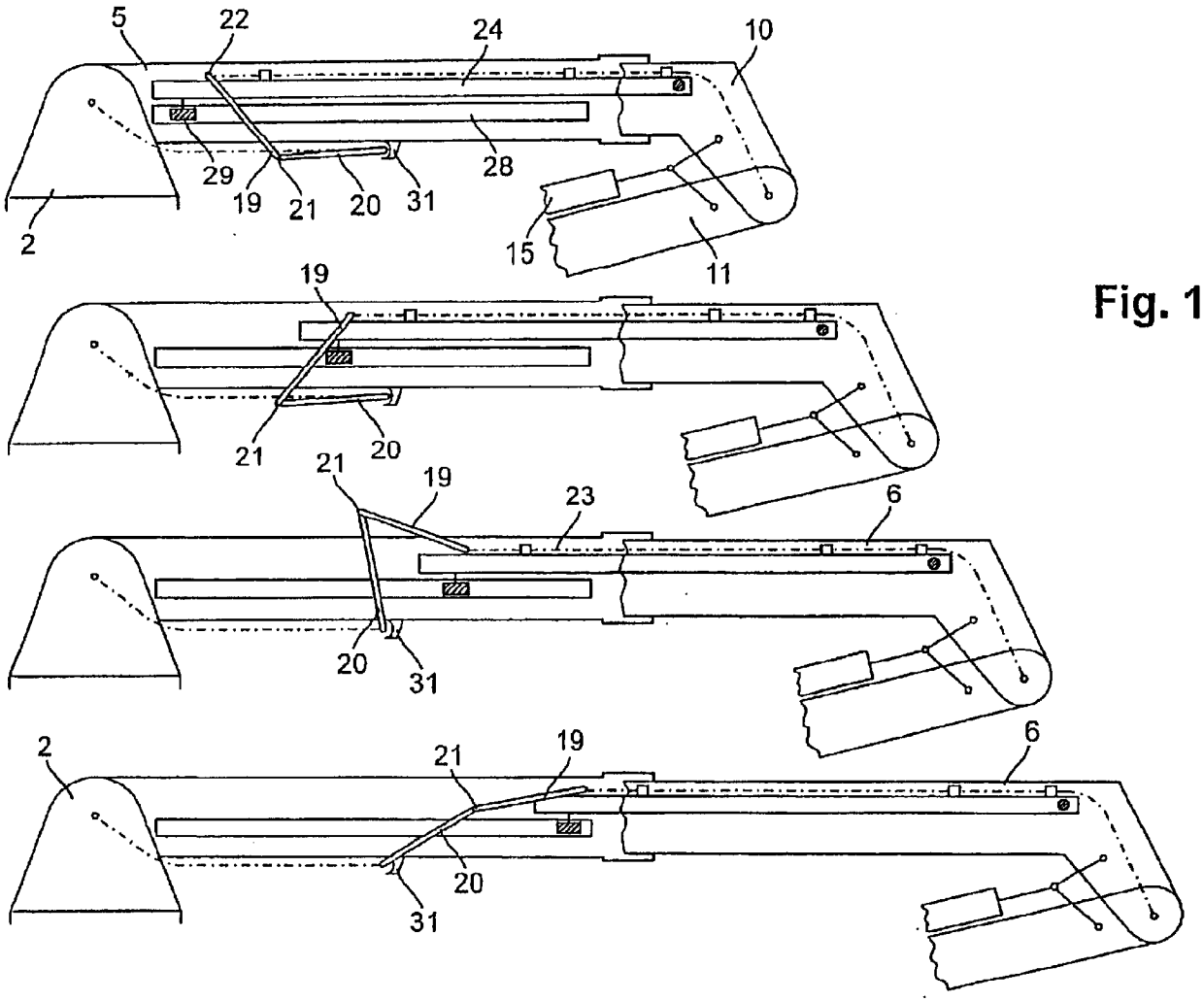
FIG. 14 shows a schematic side elevation of the telescopic boom section in various extended positions.

The other end of the reinforcement beam 24 is connected to the extensible inner telescopic component 6 by means of a swivel pin 31 in FIG. 5. The fact that the reinforcement beam 24 is movably attached to the boom via, respectively, the fulcrum pin 30 and the swivel pin 31 means that, when the inner telescopic component 6 is extended, the reinforcement beam 24 will be dragged along with it and, consequently, also the section 23 carried on the reinforcement beam 24. This is accompanied by the movement of the two swivel elements 19 and 20, inasmuch as the swivel element 19, given the articulated joint 22, will be swiveled in the clockwise direction as the inner telescopic component 6 is extended, while the second swivel element 20, being articulated to the swivel element 19, will be swiveled in the counterclockwise direction, since this second swivel element 20 is connected by means of an articulated joint 21 to the underside of the fixed telescopic component 5. The section of the concrete-conveyance conduit 17 that leads from the slewing track ring 2 to the swivel pin 31 is indicated by 32. At the swivel pin 31 this section is connected to the second swivel element 20. These conditions are also illustrated rather clearly by FIG. 7, this figure further shows that the second swivel element 20 is designed in the form of an S while the swivel element 19 is designed in the form of a C. This is of advantage for a constructionally compact arrangement of the carried concrete-conveyance conduit 17. The two aims of the C of the swivel element 19 terminate at the articulated joints 21 and 22, while the ends of the S-shaped second swivel element 20 terminate at the articulated joint 21 and swivel pin 31. When the inner telescopic component 6 is extended, the swivel elements of the scissor-type conduit assembly 18 are swiveled in such a manner that the articulated joints 20 and 21 perform a crossover motion past each other, so that the concrete-conveyance conduit 17 in the region of the telescopic section 4 can follow the extension movement of the telescope. This is illustrated rather clearly by FIG. 14, which shows the various working positions reached during the extension of the inner telescopic component 6. From FIG. 4, it can be seen that the concrete-conveyance conduit 17 in the region of the scissor-type conduit assembly 18 is made to follow the boom by virtue of the fact that the articulated joints 21 and 22 and swivel pin 31 move past each other during the extension of the inner telescopic component 6. As an alternative to the scissor-type conduit assembly 18, however, it would also be possible to use a hosepipe with an appropriate compensation loop, by means of which the telescope motion could be followed as the inner telescopic component 6 is extended outwards. These conditions, however, are not illustrated by the drawings.

With a view to assuring constructional compactness and also proper compensation of forces and moments, the section 32 of the concrete-conveyance conduit that leads to the scissor-type conduit assembly 18 is arranged, as can best be seen from FIG. 5, on the side of the fixed telescopic component 5 opposite the one to which the reinforcement beam 24 is attached. In the region of the telescopic section 4 the concrete-conveyance conduit 17 is therefore arranged on both sides of the telescopic section 4.

Figure 7:
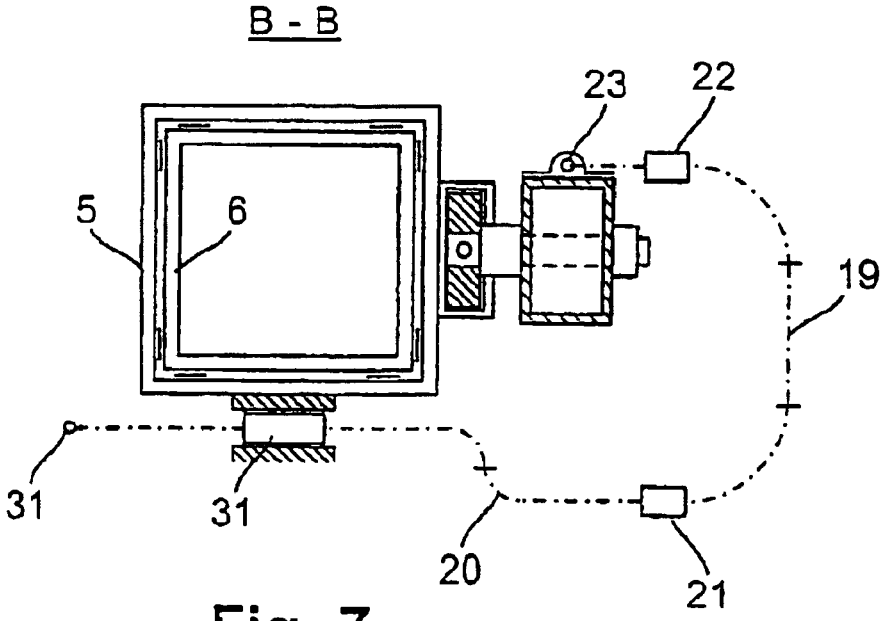
FIG. 7 shows a cross section along the line B—B of FIG. 4.
Figure 13:
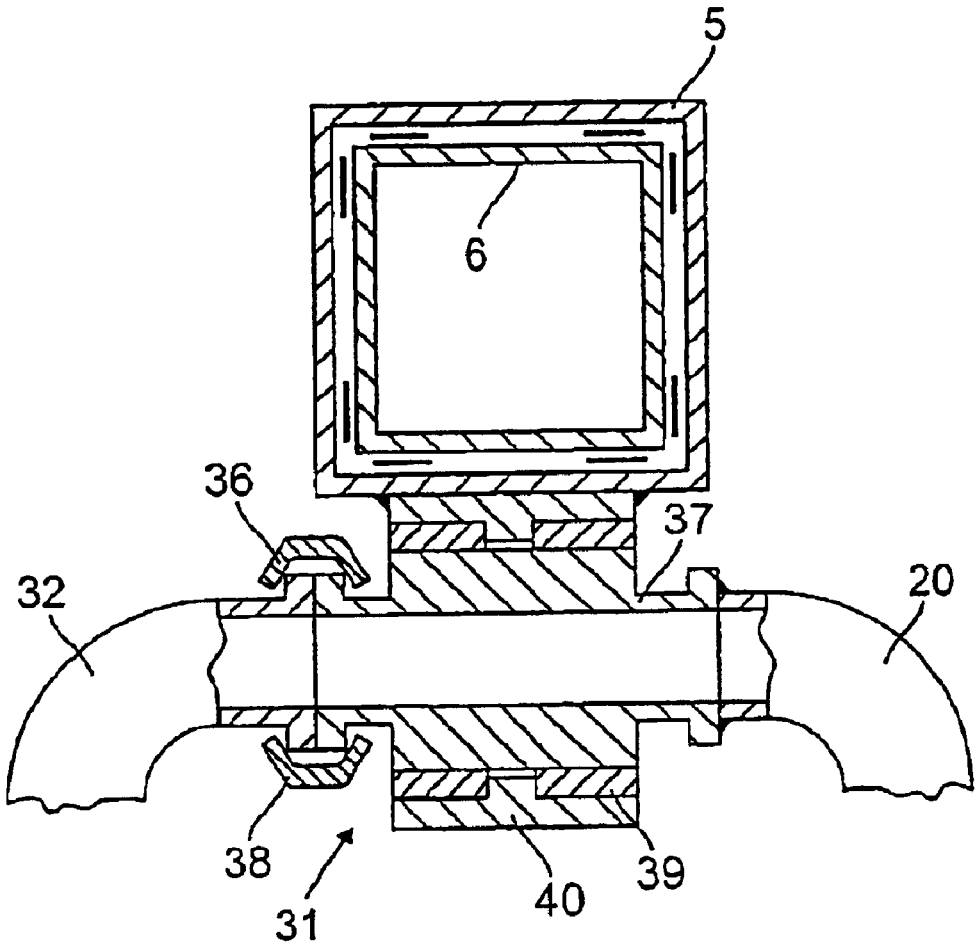
FIG. 13 shows a schematic section through an articulated joint of the scissor-type concrete-conduit assembly designed as a swivelling pipe bearing.

The articulated joints 21 and 22 and swivel pin 31 of the scissor-type conduit assembly 18 are designed as swiveling pipe connection capable of resisting bending, as is schematically indicated in FIG. 7 for the case of swivel pin 31. For this purpose the ends of the conduits adjacent to the joint may be pivotably accommodated in a bushing. To this end, however, the ends of the conduit are stiffened by means of a sleeve attached by means of welding or in some other way. FIG. 13, which illustrates the swivel pin 31 located on the underside of the fixed telescopic component 5, shows a suitable embodiment of such a pivotable conduit bearing. In this case the end of the incoming section 32 is designed with a flange 36 and connects with a corresponding bearing conduit 37 that terminates with flanges on both sides, the coupling being obtained with the help of a muff 38, here indicated only schematically. The bearing conduit 37, together with the bearing elements 39, is accommodated in a bushing 40 that is attached to the fixed telescopic component 5, preferably by means of welding. On the right-hand side can be seen the end of the S-shaped swivel element 20, which is here welded to the corresponding flange of the bearing conduit 37.

Lastly, it can be seen from FIGS. 1 and 4, that the hydraulic cylinder 15 has its piston-side end attached by means of an articulated joint to the leading or front end of the inner telescopic component 6, i.e. the end that faces the tip of the distribution boom, or, more precisely, to the angle bracket 10. Though the intermediate joints are indicated only schematically in FIG. 5, they are shown in greater detail in FIG. 1. The cylinder side of the hydraulic cylinder 15 is articulated to the subsequent foldable section 11 and, more precisely, as can be seen from FIG. 1, to a transverse bracket 33 more or less in the region of the middle of the foldable section 11. Due to this particular arrangement of the hydraulic cylinder 15 that differs from the conventional arrangement (in which the hydraulic cylinder would have one of its ends attached to the articulated linkage 34 and its other end attached to the boom section preceding the joint, in this particular case, the inner telescopic component 6), the possible throw of the telescopic section of the boom becomes enlarged, whereas in the conventional design it would be reduced by more or less the full length of the hydraulic cylinder. The illustrated arrangement therefore makes it possible to gain a corresponding telescope extension, because the outer telescopic component 5 can be brought right up to the articulated linkage 34 when the inner telescopic component 6 is retracted into its end position.

Figure 8:
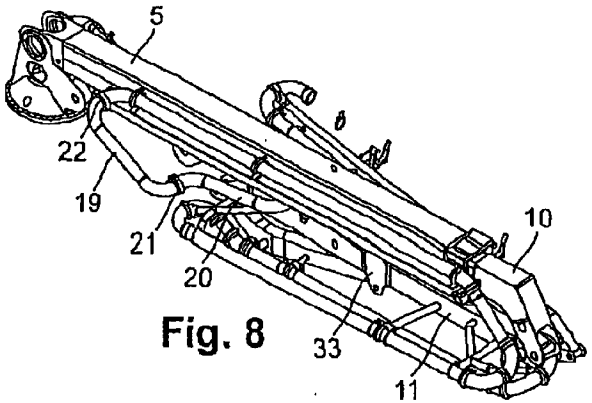
FIG. 8 shows a partial representation of a distribution boom to illustrate the concrete-conveyance conduit.
Figure 9:
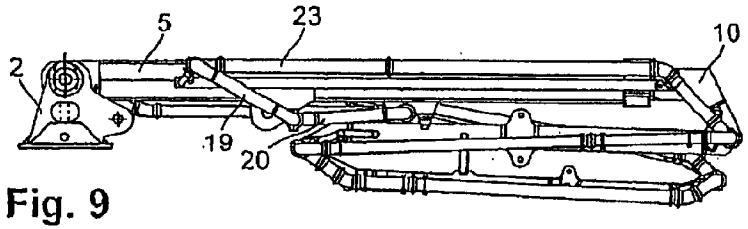
FIG. 9 shows a view of the distribution boom of FIG. 8 in its retracted position.
Figure 10:
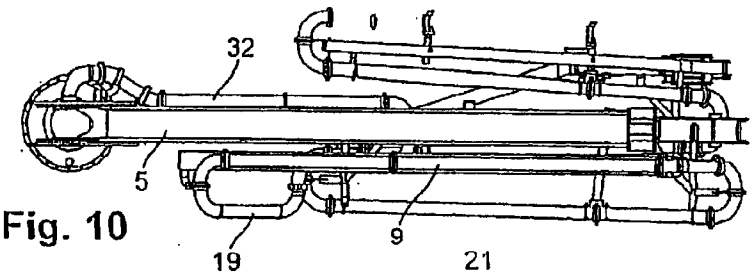
FIG. 10 shows the distribution illustrated by FIG. 5 as seen from above.
Figure 11:
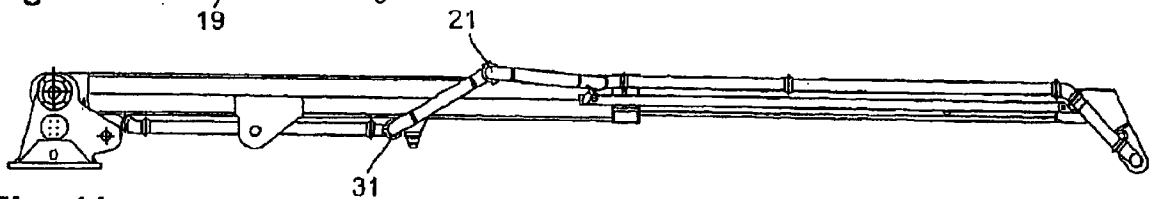
FIG. 11 shows a view of the distribution boom illustrated by FIG. 9 with the telescope in its extended position.
Figure 12:
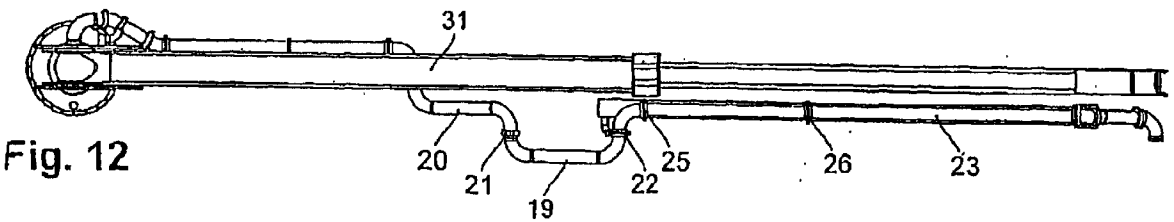
FIG. 12 shows the distribution boom of FIG. 11 as seen from above.

The actual layout of the concrete-conveyance conduit 17is brought out more clearly by FIGS. 8 to 12. FIGS. 9 and 10, as well as the perspective view of FIG. 8, show the distribution boom in the position in which the boom sections are folded back, whereas FIGS. 11 and 12, show the telescopic section of the boom without the other boom sections illustrated in the fully extended position. The respectively S- and C-shaped swivel elements 19 and 20 can be seen very clearly in FIG. 12. In this connection it should be noted that, with a view to rendering FIGS. 8 to 12 more readily comprehensible, certain details have been omitted, including, in particular, the reinforcement beam 24, which is attached to the side of the relatively immobile part of the boom, i.e. the fixed telescopic component 5, and carries the concrete-conveyance conduit and therefore assures an unconstrained guidance. Examining FIG. 1, in particular, one notes that, due to the fact that the telescopic section 4 is coupled to the slewing tract ring 2 and that the other boom sections are attached to the telescopic boom section by means of articulated joints, this distribution boom is particularly suitable for construction sites where the unobstructed working height is limited, since this structural arrangement gives rise to very good slip-in properties, which make it possible for the boom tip to be very readily introduced into windows or other openings in the walls in order to gain access to the interior spaces. Given the stepless adjustability of the telescopic boom section, the boom can be made to bear against building edges with millimetric precision.

Figure 6:
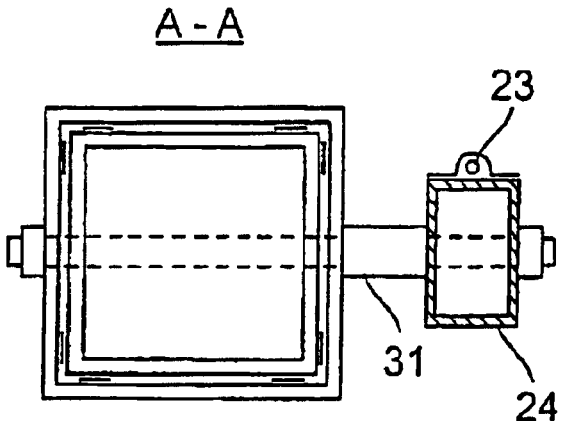
FIG. 6 shows a cross section along the line A—A of FIG. 4.

As can best be seen from FIGS. 6 and 7, the two telescopic components 5 and 6 are designed as box sections having a substantially rectangular cross section. The reinforcement beam 24 is likewise designed as a box section, i.e. as a fully closed hollow section, and the shape of the cross section is again substantially rectangular.

The other supply lines, which include hydraulic hoses, electric cables and pipes, are bundled and therefore constitute a supply bundle that can readily be made to follow a course corresponding to the scissor-type assembly alongside the elements of the concrete-conveyance conduit and be appropriately attached thereto.

While the present invention has been described in terms of a preferred embodiment, it is apparent that other forms could be adopted by one skilled in the art. In other words, the teachings of the present invention encompass any reasonable substitutions or equivalents of claim limitations. For example, the structure, materials, sizes, and shapes of the individual components could be modified, or substituted with other similar structure, materials, sizes, and shapes. Those skilled in the art will appreciate that other applications, including those outside of the concrete industry, are possible with this invention. Accordingly, the scope of the present invention is to be limited only by the following claims.

What is claimed is:

1. A distribution device for dense substances, especially concrete, said distribution device comprising:

a distribution boom (1) carrying a concrete-conveyance conduit (17), said distribution boom having at least one telescopic boom section (4) having a first telescope component (5) and a second telescope component, (6) said second telescopic component being extendable with respect to said first telescope component; and at least one reinforcement beam (24) arranged on one of said first and second telescope components said at least one reinforcement beam carrying a section of the concrete-conveyance conduit;

said section of concrete-conveyance conduit in the region of said telescopic boom section comprising a flexible hose having a compensation loop to accommodate the extension movement of the telescopic boom section, said compensation loop having at least one scissor-type conduit assembly (18) having two swivel elements (19,20) connected to each other in such a manner that the swivel elements in the two terminal positions of the telescopic boom section (4) are substantially arranged in a crossover position and, articulated joints (21, 22) that interconnect them, said articulated joints moving past each other during the extension and retraction of the telescopic boom section, and a reinforcement beam (24) carrying a section of the concrete-conveyance conduit in the region of the telescopic boom section, (4) said reinforcing beam having one of its ends connected to said second telescope component (6) and its other end connected to said first telescope component (5) that is relatively immobile with respect to said second telescope component.

2. A distribution boom in accordance with claim 1, wherein said reinforcement beam (24) has its leading end firmly attached to said second extensible telescope component in a fixed position; by means of an articulated joint, and its trailing end attached to said first immobile telescope component (5) in such a manner as to be able to slide in a guide along it.

3. A device in accordance with claim 1, wherein said reinforcement beam is guided on the side of said relatively immobile first telescope component (5) in a longitudinal guide (28) attached to said first telescope component.

4. A device in accordance with claim 3, wherein said reinforcement beam is guided by means of at least one guide roller or slider in said longitudinal guide designed as a guide rail having a dovetail-shaped groove.

5. A device in accordance with claim 1, wherein said reinforcement beam (24) comprises a hollow section, capable of resisting both bending and torsion.

6. A device in accordance with claim 1, further comprising:

a section (23) of concrete-conveyance conduit connected to said scissor type conduit assembly is arranged on the reinforcement beam (24).

7. A device in accordance with claim 6, wherein said section (23) of the concrete-conveyance conduit is arranged on the top surface of the reinforcement beam (24).

8. A device in accordance with claim 6, wherein said scissor-type conduit assembly consisting of two swivel elements (19, 20) has one end connected to a swivelling bearing (31) attached to said first telescope component and an other end connected by means of an articulated joint to said section (23) of the concrete-conveyance conduit carried on said reinforcement beam.

9. A device in accordance with claim 8, wherein said articulation joints (22, 31) and swivelling bearing of the scissor-type conduit assembly (18), (21) that connects said two swivel elements (19, 20), consist of swivelling pipe connections capable of resisting bending.

10. A device in accordance with claim 1 wherein said scissor-type conduit assembly consists of a c-shaped swivel element (19) and an S-shaped swivel element (20).

11. A device in accordance with claim 1, further comprising:

a section of concrete-conveyance conduit (17) that leads to the scissor-type conduit assembly is arranged on the side of the telescopic boom section that is opposite to the side that carries the reinforcement beam (24) and the section (23) of the concrete-conveyance conduit that leads away from the scissor-type conduit assembly.

12. A device in accordance with claim 10, further comprising:

a connection of the scissor-type conduit assembly (18) to the section (32) of the concrete-conveyance conduit is constituted by said S-shaped swivel element (20).

13. A device in accordance with claim 1, characterized in that:

the reinforcement beam (24) has its leading end connected by means of a pin (31) to said end of said extensible second telescope component (6) that faces the boom tip.

14. A distribution device for conveying slurry-like materials, said distribution device comprising:

a telescopic distribution beam having a plurality of components articulated to each other, at least one of said plurality of components being a telescopic section capable of telescopic movement between a retracted position and an extended telescopic position, said at least one telescopic section comprising a first telescopic component and a second telescopic component extendable with respect to said first telescopic component;

at least one reinforcement beam having one end mounted to said first telescopic component and an opposite end attached to said second telescopic component;

means for conveying materials from one end of said telescopic distribution beam to an opposite end of said telescopic distribution beam, one end of said conveying means being fixedly mounted to said first telescopic component and said opposite end of said conveying means being fixedly mounted to a terminal end of said last articulated component of said telescopic distribution beam;

said means for conveying further having an intermediate portion mounted to said at least one reinforcement beam; and means for translating said at least one reinforcement beam along said first telescopic component, said translating means interposed said first telescopic component and said at least one reinforcement beam, whereby as said second telescopic component moves with respect to said first telescopic component said at least one reinforcement beam with said intermediate portion of said conveying means mounted thereon translates with said second telescopic component to move said conveying means along with said plurality of articulated components into position to enable dispensing of said materials.

15. The distribution device as claimed in claim 14 wherein said means for translating further comprises means for attaching said opposite end of said at least one reinforcement beam to said second telescopic component.

16. The distribution device as claimed in claim 15 wherein said means for attaching said opposite end of said at least one reinforcement beam further comprises a fixed pivotable joint interposed said at least one reinforcement beam and said second telescopic component.

17. The distribution device as claim in claim 14 wherein said means for translating further comprises a guide rail attached to said first telescopic component.

18. The distribution device as claimed in claim 17 wherein said means for translating further comprises a guide follower having one end pivotally attached to said at least one reinforcement beam and an opposite end moveably mounted with respect to said guide rail such that as said second telescopic component translates from a fully retracted to a fully extended position with respect to said first telescopic component said at least one reinforcement beam moves along with said second telescopic component to a forward end of travel position and further whereby as said second telescopic component translated from a fully extended to a fully retracted position said at least one reinforcement beam moves along with said second telescopic component to a rearward end of travel position.

* * * * *

UNITED STATES PATENT AND TRADEMARK OFFICE

CERTIFICATE OF CORRECTION

PATENT NO. : 6,871,667 B2 
APPLICATION NO. : 10/467787
DATED : March 29, 2005
INVENTOR(S) : Fredrich Schwing and Horst Heckmann It is certified that error appears in the above-identified patent and that said Letters Patent is hereby corrected as shown below:

The title page, showing the illustrative figures, should be deleted to be replaced with the attached title page.

In the drawings, Sheet 1 of 6, Fig. 1, kindly delete reference character "170", and insert reference character --17--.

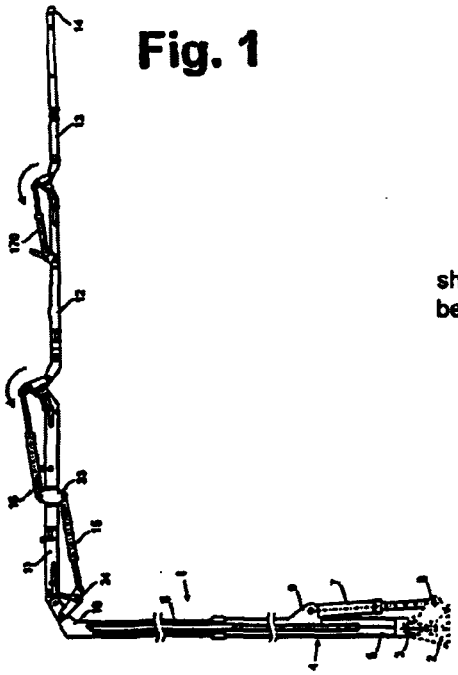

should be

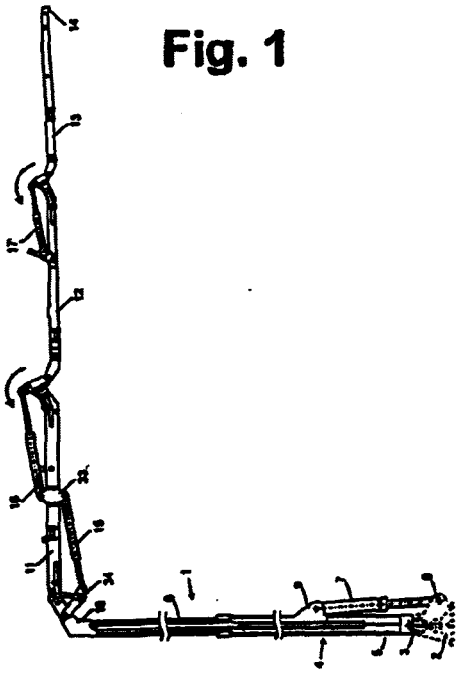

UNITED STATES PATENT AND TRADEMARK OFFICE

CERTIFICATE OF CORRECTION

PATENT NO. : 6,871,667 B2
APPLICATION NO. : 10/467787
DATED : March 29, 2005
INVENTOR(S) : Fredrich Schwing and Horst Heckmann It is certified that error appears in the above-identified patent and that said Letters Patent is hereby corrected as shown below:

In the drawings, Sheet 2 of 6, Fig. 4, kindly delete reference character "17" and insert reference character --17a--.

Fig. 4

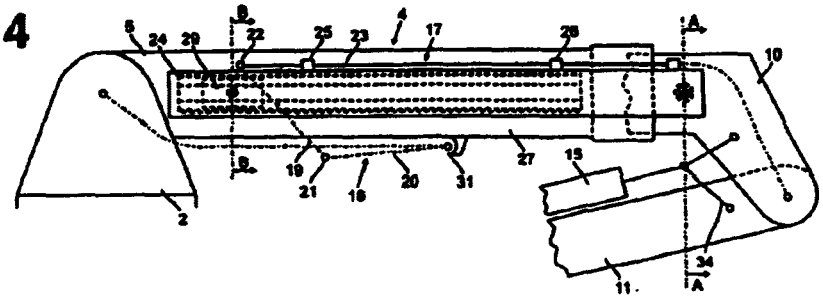

should be

Fig. 4

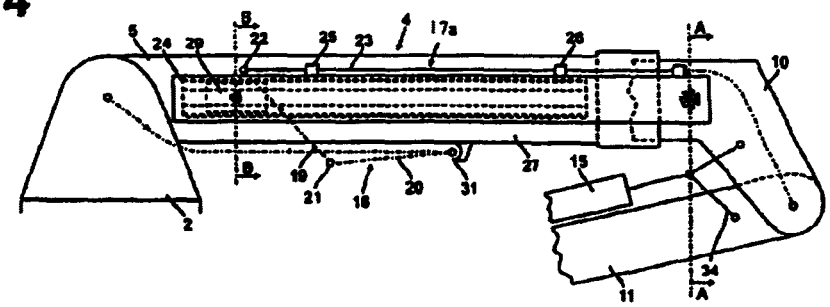

In the Title, Line 54 delete "DISTRIBUTION DEVICE FOR THICK MATTER, ESPECIALLY FOR CONCRETE" and insert --DISTRIBUTION DEVICE FOR DENSE SUBSTANCES, ESPECIALLY CONCRETE--.

Column 1, line 1, delete "DISTRIBUTION DEVICE FOR THICK MATTER, ESPECIALLY FOR CONCRETE" and insert --DISTRIBUTION DEVICE FOR DENSE SUBSTANCES, ESPECIALLY CONCRETE--.

Column 1, line 3, insert the subtitle --CROSS-REFERENCES TO RELATED APPLICATIONS--.

Column 1, line 4, insert --This national application claims the benefit of prior filed Germany Patent Application No. 101 06 427.6, filed on February 12, 2001 and prior filed PCT Application No. PCT/EP02/01290, filed on February 7, 2002. --.

UNITED STATES PATENT AND TRADEMARK OFFICE

CERTIFICATE OF CORRECTION

PATENT NO. : 6,871,667 B2
APPLICATION NO. : 10/467787
DATED : March 29, 2005
INVENTOR(S) : Fredrich Schwing and Horst Heckmann It is certified that error appears in the above-identified patent and that said Letters Patent is hereby corrected as shown below:

Column 1, line 36, after "telescopic" insert --section--.

Column 1, line 62, delete "claim" and insert --Claim--.

Column 2, line 44, delete "an" and insert --a--.

Column 4, line 60, delete "17. The concrete-conveyance conduit 17" and insert --17a. The concrete-conveyance conduit 17a--.

Column 4, line 63, delete "17" and insert --17a--.

Column 5, line 11, delete "17" and insert --17a--.

Column 5, line 13, delete "17" and insert --17a--.

Column 5, line 47, delete "17" and insert --17a--.

Column 5, line 55, delete "17" and insert --17a--.

Column 5, line 56, delete "aims" and insert --arms--.

Column 5, line 63, delete "17" and insert --17a--.

Column 6, line 2, delete "17" and insert --17a--.

Column 6, line 15, after "conduit" insert --17a--.

Column 6, line 20, delete "17" and insert --17a--.

Column 6, line 60, delete "6)," and insert --6, --.

Column 7, line 1, delete "17" and insert --17a--.

Column 7, line 15 after "conduit" insert --17a--.

Column 8, line 7, delete "(19,20)" and insert -- (19, 20)--.

Column 8, line 24, delete ";" and insert --.--.

UNITED STATES PATENT AND TRADEMARK OFFICE

CERTIFICATE OF CORRECTION

PATENT NO. : 6,871,667 B2
APPLICATION NO. : 10/467787
DATED : March 29, 2005
INVENTOR(S) : Fredrich Schwing and Horst Heckmann It is certified that error appears in the above-identified patent and that said Letters Patent is hereby corrected as shown below:

Column 8, line 56, after "(18)," delete "(21)".

Column 8, line 60, delete "c-shaped" and insert --C-shaped--.

Column 10, line 20, delete "claim" and insert --claimed--.

Signed and Sealed this

Eighth Day of August, 2006

JON W. DUDAS
*Director of the United States Patent and Trademark Office*

(12) United States Patent
Schwing et al.

(10) Patent No.: US 6,871,667 B2
(45) Date of Patent: Mar. 29, 2005

(54) DISTRIBUTION DEVICE FOR THICK MATTER, ESPECIALLY FOR CONCRETE

(75) Inventors: Friedrich Schwing, Gelsenkirchen (DE); Horst Heckmann, Sprockhövel (DE)

(73) Assignee: Schwing GmbH, Herne (DE)

( * ) Notice: Subject to any disclaimer, the term of this patent is extended or adjusted under 35 U.S.C. 154(b) by 0 days.

(21) Appl. No.: 10/467,787

(22) PCT Filed: Feb. 7, 2002

(86) PCT No.: PCT/EP02/01290

§ 371 (c)(1),
(2), (4) Date: Jan. 22, 2004

(87) PCT Pub. No.: WO02/064911

PCT Pub. Date: Aug. 22, 2002

(65) Prior Publication Data

US 2004/0108003 A1 Jun. 10, 2004

(30) Foreign Application Priority Data

Feb. 12, 2001 (DE) ..... 101 06 427

(51) Int. Cl.[7] ..... G05D 7/00
(52) U.S. Cl. ..... 137/615; 141/387
(58) Field of Search ..... 137/615; 141/387, 141/388

(56) References Cited

U.S. PATENT DOCUMENTS 3,707,990 A 1/1973 Schaible
4,130,134 A 12/1978 Castle
5,535,780 A * 7/1996 Schlecht et al. ..... 137/615
6,463,958 B1 10/2002 Schwing

FOREIGN PATENT DOCUMENTS

EP 432 854 B1 11/1990
WO WO 00/24988 10/1999

* cited by examiner

*Primary Examiner*—Kevin Lee
(74) *Attorney, Agent, or Firm*—VanOphem & VanOphem P.C.

(57) ABSTRACT

A distribution device for dense substances, especially concrete, with a distribution boom carrying a concrete-conveyance conduit, with at least one telescopic boom section (4) consisting of a first telescopic component and a second telescope component (6) that can be extended with respect to this first component, as well as at least one reinforcement beam that is arranged on one of the telescope components and carries a section of the concrete-conveyance conduit, wherein a section of the concrete-conveyance conduit in the region of the telescopic boom sections consists of a flexible hose with a compensation loop to accommodate the extension movement of the telescopic motion or of at least one scissor-type conduit assembly made up of swivel elements connected to each other in such a manner than the swivel elements in the two terminal positions of the telescopic boom section are substantially arranged in a crossover position and, together with the articulated joints that interconnect them, move past each other during the extension and retraction of the telescopic boom section, is characterized in that the reinforcement beam that carries a section of the concrete-conveyance conduit in the region of the telescopic boom section has one of its ends connected to the extensible (second) telescope component and its other end connected to the relatively immobile (first) telescope component.

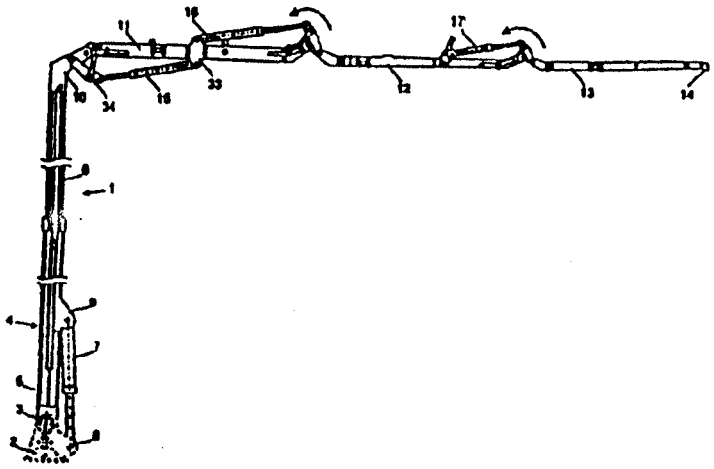

18 Claims, 6 Drawing Sheets